US008658577B2

(12) United States Patent
Nagatomi et al.

(10) Patent No.: US 8,658,577 B2
(45) Date of Patent: Feb. 25, 2014

(54) ANTI-WEAR AGENT AND LUBRICATING COMPOSITION WITH SUPERIOR ANTI-WEAR PROPERTIES CONTAINING SAME

(75) Inventors: Eiji Nagatomi, Tokyo (JP); Tetsuo Wakizono, Kanagawa (JP)

(73) Assignee: Shell Oil Company, Houston, TX (US)

( * ) Notice: Subject to any disclaimer, the term of this patent is extended or adjusted under 35 U.S.C. 154(b) by 160 days.

(21) Appl. No.: 13/146,219

(22) PCT Filed: Jan. 28, 2010

(86) PCT No.: PCT/EP2010/050980

§ 371 (c)(1),
(2), (4) Date: Aug. 18, 2011

(87) PCT Pub. No.: WO2010/086357

PCT Pub. Date: Aug. 5, 2010

(65) Prior Publication Data

US 2011/0294709 A1 Dec. 1, 2011

(30) Foreign Application Priority Data

Jan. 28, 2009 (JP) ..... 2009-016735

(51) Int. Cl.

| | |
|---|---|
| ***C07F 9/6571*** | (2006.01) |
| ***C10M 135/02*** | (2006.01) |
| ***C10M 137/10*** | (2006.01) |
| ***C10M 159/12*** | (2006.01) |

(52) U.S. Cl.
USPC ..... 508/422; 508/329; 508/368; 508/328

(58) Field of Classification Search
USPC ..... 508/328, 329, 369, 368, 422
See application file for complete search history.

(56) References Cited

U.S. PATENT DOCUMENTS

| | | | | |
|---|---|---|---|---|
| 2,364,283 | A | 12/1944 | Frenler | 252/37 |
| 2,364,284 | A | 12/1944 | Frenler | 252/39 |
| 2,965,666 | A * | 12/1960 | Debo | 558/138 |
| 5,360,563 | A | 11/1994 | Zinke et al. | 252/46.7 |
| 2004/0038834 | A1 * | 2/2004 | Gahagan | 508/192 |
| 2004/0242434 | A1 | 12/2004 | Yagishita et al. | 508/291 |

FOREIGN PATENT DOCUMENTS

| | | | |
|---|---|---|---|
| JP | 4166872 | 10/1990 | G03G 15/09 |
| JP | 2001354987 | 12/2001 | C10M 169/04 |
| JP | 2002020779 | 1/2002 | C10M 135/18 |
| JP | 3662228 | 10/2003 | C10M 129/10 |
| JP | 2008266367 | 11/2008 | C10M 101/12 |

OTHER PUBLICATIONS

Cupertino, D. et al.; "Preparation and single-crystal characterization of iPr2P(S)NHP(S)iPr2 and homoleptic [iPr2P(S)NP(S)iPr2]-complexes of zinc, cadmium and Nickel"; vol. 35, pp. 2695-2697; 1996.
Siiman, O. et al; "Synthesis of copper thio-and dithioimidodiphosphinates. Infrared and Raman spectra of imidodiphosphinates"; Inorganic Chemistry; CODEN: INOCAJ; ISSN: 0020-1669; pp. 1672-1673; 1980.
Schmidpeter, A. et al.; "Imidophosphinato metal chelates; neutral complexes with carbon-free chelate rings"; Angewandte Chemie, 76(20), 860-1 CODEN: ANCEAD; ISSN: 0044-8249; p. 860; 1964.

* cited by examiner

*Primary Examiner* — James Goloboy
*Assistant Examiner* — Francis C Campbell

(57) ABSTRACT

The present invention provides an anti-wear compound selected from phosphorus compounds as represented by the following General Formula (2) or metal salts thereof as represented by the following General Formula (3).

18 Claims, 1 Drawing Sheet

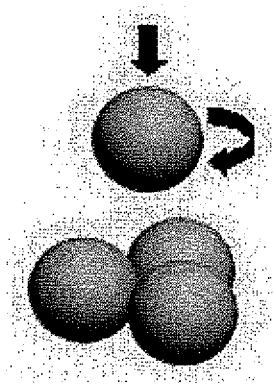

ANTI-WEAR AGENT AND LUBRICATING COMPOSITION WITH SUPERIOR ANTI-WEAR PROPERTIES CONTAINING SAME

CROSS REFERENCE TO EARLIER APPLICATIONS

The present application is a national stage application of International application No. PCT/EP2010/050980, filed 28 Jan. 2010, which claims priority from JP 2009-016735, filed on 28 Jan. 2009, both of which are incorporated herein by reference.

FIELD OF THE INVENTION

This invention relates to a novel anti-wear compound and to a lubricating composition with superior anti-wear properties containing same.

BACKGROUND OF THE INVENTION

Anti-wear agents are blended with lubricating agents in order to regulate the anti-wear properties to a suitable level. These anti-wear agents are being used in lubricating compositions such as lubricating oils for automotive vehicles, primarily including high-performance engine oils and gear oils, and industrial lubricating oils such as hydraulic oils. Many types of compounds have been proposed for these anti-wear agents.

The most representative of these anti-wear agents are zinc dithiophosphates (referred to as "ZnDTPs" hereinafter). These organozinc compounds are compounds denoted by the following General Formula (1), as can be seen in U.S. Pat. Nos. 2,364,283 and 2,364,284.

(1)

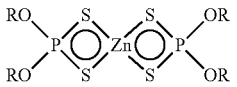

Anti-wear properties are important in the performance of lubricating oils, and many techniques for blending various anti-wear agents have been disclosed in the prior art in order to maintain that performance. In particular, the aforementioned ZnDTPs have been used as anti-wear agents for a long time. "Shinpan Sekiyu Seihin Tenkazai" (Petroleum Product Additives, New Edition), edited by Sakurai Toshio and published by Saiwai Shobo Ltd. on 25 Jul. 1986 and the following Patent References also disclose the use of phosphorus-containing compounds having anti-wear properties:

Japanese Patent No. 3662228,
Japanese Patent No. 4166872,
Japanese Laid-open Patent 2001-354987,
Japanese Laid-open Patent 2002-20779, and
Japanese Laid-open Patent 2008-266367.

As mentioned above, anti-wear properties are important in the performance of lubricating oils, and anti-wear agents are being used in lubricating compositions such as high-performance lubricating oils for automotive vehicles and industrial lubricating oils. The techniques of the prior art relating to anti-wear agents used in prior high-performance lubricating oils have nearly all been achieved by the addition of ZnDTPs. In this invention, as the result of intensive research on novel compounds having anti-wear properties, it has been discovered that certain phosphorus compounds having a specified structure have superior anti-wear properties. In other words, the inventors have discovered phosphorus compounds exhibiting superior anti-wear properties of the same order as the ZnDTPs of the prior art, and so have arrived at completion of this invention.

SUMMARY OF THE INVENTION

In a first aspect, the present invention provides a novel anti-wear compound selected from phosphorus compounds as represented by the following General Formula (2) or metal salts thereof as represented by the following General Formula (3):

(2)

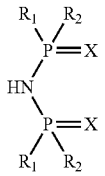

(3)

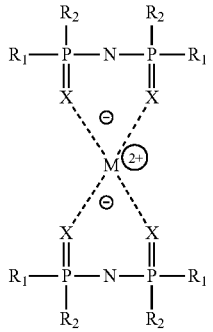

wherein in General Formulas (2) and (3), $R_1$ and $R_2$ each independently represent groups selected from the group consisting of hydrogen, alkyl groups with from 1 to 30 carbons, cycloalkyl groups and aryl groups, and wherein X denotes O or S, and M denotes a metal atom, preferably selected from zinc, molybdenum, copper and tungsten.

In a second aspect, the present invention provides a lubricating composition with superior anti-wear properties which contains a base oil and at least one kind of phosphorus compound selected from phosphorus compounds as represented by the aforementioned General Formula (2) or metal salts thereof as represented by the aforementioned General Formula (3), and wherein the content of the aforesaid phosphorus compounds or metal salts thereof is from 0.01 to 10% by weight in terms of elemental phosphorus and based on the total amount of the lubricating composition.

BRIEF DESCRIPTION OF THE DRAWING

The invention will be further illustrated by means of the FIGURE, which is an illustration of a test setup.

DETAILED DESCRIPTION OF THE PREFERRED EMBODIMENTS

The following may be mentioned as examples of compounds of the aforementioned General Formula (2). In the case where $R_1$ and $R_2$ are alkyl groups, it is certainly possible for $R_1$ and $R_2$ not to be the same, but in the following specific cases $R_1$ and $R_2$ are the same and X denotes sulphur.

Imino-bis(dimethylphosphine sulphide), imino-bis(diethylphosphine sulphide), imino-bis(dipropylphosphine sulphide), imino-bis(dibutylphosphine sulphide), imino-bis(dipentylphosphine sulphide), imino-bis(dihexylphosphine sulphide), imino-bis(diheptylphosphine sulphide), imino-bis(dioctylphosphine sulphide), imino-bis(dinonylphosphine sulphide), imino-bis(didecylphosphine sulphide), imino-bis(diundecylphosphine sulphide), imino-bis(didodecylphosphine sulphide), imino-bis(ditridecylphosphine sulphide), imino-bis(ditetradecylphosphine sulphide), imino-bis(dipentadecylphosphine sulphide), imino-bis(dihexadecylphosphine sulphide), imino-bis(diheptadecylphosphine sulphide), imino-bis(dioctadecylphosphine sulphide), imino-bis(dinonadecylphosphine sulphide), imino-bis(dieicosylphosphine sulphide), imino-bis(diheneicosylphosphine sulphide), imino-bis(didocosylphosphine sulphide), imino-bis(ditricosylphosphine sulphide), imino-bis(ditetracosylphosphine sulphide), imino-bis(dipentacosylphosphine sulphide), and so on.

Also, in the case where $R_1$ and $R_2$ are cycloalkyl groups, it is certainly possible for $R_1$ and $R_2$ not to be the same, but in the following specific cases $R_1$ and $R_2$ are the same and X denotes sulphur.

Imino-bis(dicyclobutylphosphine sulphide), imino-bis(dicyclopentylphosphine sulphide), imino-bis(dicyclohexylphosphine sulphide), imino-bis(dicycloheptylphosphine sulphide), imino-bis(dicyclooctylphosphine sulphide), and so on.

Also, in the case where $R_1$ and $R_2$ are aryl groups, it is certainly possible for $R_1$ and $R_2$ not to be the same, but in the following specific cases $R_1$ and $R_2$ are the same and X denotes sulphur.

Imino-bis(diphertylphosphine sulphide), imino-bis(ditoluoylphosphine sulphide), imino-bis(dixylylphenylphosphine sulphide), imino-bis(diethylphenylphosphine sulphide), and so on.

The following may be mentioned as examples of compounds of the aforementioned General Formula (3). In the case where $R_1$ and $R_2$ are alkyl groups, it is certainly possible for $R_1$ and $R_2$ not to be the same, but in the following specific cases $R_1$ and $R_2$ are the same and X denotes sulphur.

Zinc [imino-bis(dimethylphosphine sulphide), zinc [imino-bis(diethylphosphine sulphide)]$_2$, zinc [imino-bis(dipropylphosphine sulphide)]$_2$, zinc [imino-bis(dibutylphosphine sulphide)]$_2$, zinc [imino-bis(dipentylphosphine sulphide)]$_2$, zinc [imino-bis(dihexylphosphine sulphide)]$_2$, zinc [imino-bis(diheptylphosphine sulphide)]$_2$, zinc [imino-bis(dioctylphosphine sulphide)]$_2$, zinc [imino-bis(dinonylphosphine sulphide)]$_2$, zinc [imino-bis(didecylphosphine sulphide)]$_2$, zinc [imino-bis(diundecylphosphine sulphide)]$_2$, zinc [imino-bis(didodecylphosphine sulphide)]$_2$, zinc [imino-bis(ditridecylphosphine sulphide)]$_2$, zinc [imino-bis(ditetradecylphosphine sulphide)]$_2$, zinc [imino-bis(dipentadecylphosphine sulphide)]$_2$, zinc [imino-bis(dihexadecylphosphine sulphide)]$_2$, zinc [imino-bis(diheptadecylphosphine sulphide)]$_2$, zinc [imino-bis(dioctadecylphosphine sulphide)]$_2$, zinc [imino-bis(dinonadecylphosphine sulphide)]$_2$, zinc [imino-bis(dieicosylphosphine sulphide)]$_2$, zinc [imino-bis(diheneicosylphosphine sulphide)]$_2$, zinc [imino-bis(didocosylphosphine sulphide)]$_2$, zinc [imino-bis(ditricosylphosphine sulphide)]$_2$, zinc [imino-bis(ditetracosylphosphine sulphide)]$_2$, zinc [imino-bis(dipentacosylphosphine sulphide)]$_2$, and so on.

Also, in the case where $R_1$ and $R_2$ are cycloalkyl groups, it is certainly possible for $R_1$ and $R_2$ not to be the same, but in the following specific cases $R_1$ and $R_2$ are the same and X denotes sulphur.

Zinc [imino-bis(dicyclobutylphosphine sulphide)]$_2$, zinc [imino-bis(dicyclopentylphosphine sulphide)]$_2$, zinc [imino-bis(dicyclohexylphosphine sulphide)]$_2$, zinc [imino-bis(dicycloheptylphosphine sulphide)]$_2$, zinc [imino-bis(dicyclooctylphosphine sulphide)]$_2$, and so on.

Also, in the case where $R_1$ and $R_2$ are aryl groups, it is certainly possible for $R_1$ and $R_2$ not to be the same, but in the following specific cases $R_1$ and $R_2$ are the same and X denotes sulphur.

Zinc [imino-bis(diphenylphosphine sulphide)]$_2$, zinc [imino-bis(ditoluoylphosphine sulphide)]$_2$, zinc [imino-bis(dixylylphosphine sulphide)]$_2$, zinc [imino-bis(diethylphenylphosphine sulphide)]$_2$, and so on.

The organophosphorus compounds according to this invention may be obtained by, for example, the following method.

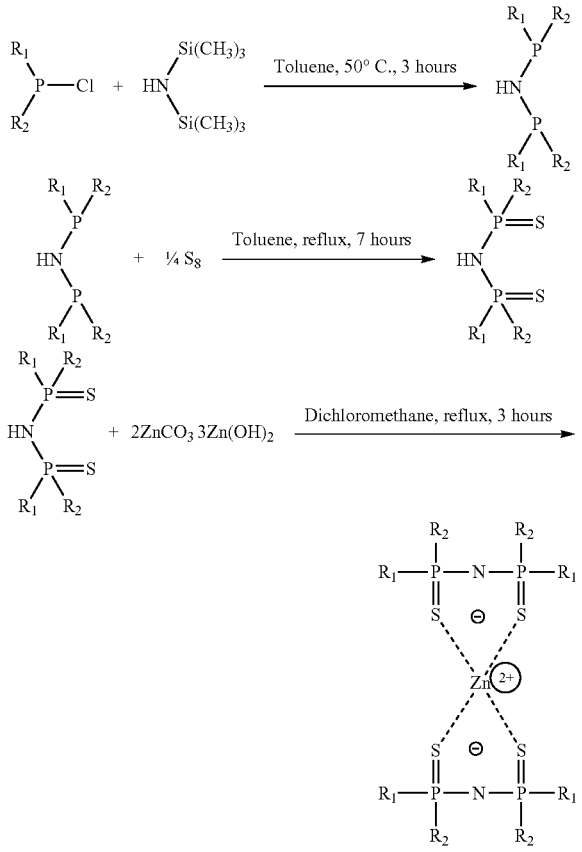

Mention may be made of lubricating oils and greases as lubricating compositions of this invention. The amount of the compounds of the invention present in lubricating compositions is similar to anti-wear agents of the prior art, and they are incorporated, for example, in terms of the total amount of the composition, in the proportion of from 0.01 to 10% by weight, and preferably from 0.03 to 5% by weight, as converted to elemental phosphorus.

For the base oil of the present lubricating composition it is possible to use the mineral oils, synthetic oils and mixtures thereof used in normal lubricating oils, and in particular it is possible to use, singly or as mixtures, base oils which belong to Group I, Group II, Group III, Group IV, Group V and so on of the API (American Petroleum Institute) base oil categories.

Group I base oils include, for example, paraffinic mineral oils obtained by application of a suitable combination of refining processes such as solvent refining, hydrorefining, and dewaxing in respect of lubricating oil fractions obtained by atmospheric distillation of crude oil. The viscosity index may be from 80 to 120 and preferably from 95 to 110. The kinematic viscosity at 40° C. may preferably be from 2 to 680 $mm^2/s$ and even more preferably from 8 to 220 $mm^2/s$. Also, the total sulphur content may be less than 700 ppm and preferably less than 500 ppm. The total nitrogen content may be less than 50 ppm and preferably less than 25 ppm. In addition, oils with an aniline point of from 80 to 150° C. and preferably from 90 to 120° C. may be used.

Group II base oils include, for example, paraffinic mineral oils obtained by application of a suitable combination of refining processes such as hydrorefining and dewaxing in respect of lubricating oil fractions obtained by atmospheric distillation of crude oil. Group II base oils refined by hydrorefining methods such as the Gulf Company method have a total sulphur content of less than 10 ppm and an aromatic content of not more than 5% and so are suitable for this invention. The viscosity of these base oils is not specially limited, but the viscosity index may be from 90 to 125 and preferably from 100 to 120. The kinematic viscosity at 40° C. may preferably be from 2 to 680 $mm^2/s$ and even more preferably from 8 to 220 $mm^2/s$. Also, the total sulphur content may be less than 700 ppm, preferably less than 500 ppm and even more preferably less than 10 ppm. The total nitrogen content may be less than 10 ppm and preferably less than 1 ppm. In addition, oils with an aniline point of from 80 to 150° C. and preferably from 100 to 135° C. may be used.

Group III base oils and Group II+ base oils include paraffinic mineral oils manufactured by a high degree of hydrorefining in respect of lubricating oil fractions obtained by atmospheric distillation of crude oil, base oils refined by the Isodewax process which dewaxes and substitutes the wax produced by the dewaxing process with isoparaffins, and base oils refined by the Mobil wax isomerisation process. These too are suitable for this invention. The viscosity of these base oils is not specially limited, but the viscosity index may be from 95 to 145 and preferably from 100 to 140. The kinematic viscosity at 40° C. may preferably be from 2 to 680 $mm^2/s$ and even more preferably from 8 to 220 $mm^2/s$. Also, the total sulphur content may be from 0 to 100 ppm and preferably less than 10 ppm. The total nitrogen content may be less than 10 ppm and preferably less than 1 ppm. In addition, oils with an aniline point of from 80 to 150° C. and preferably from 110 to 135° C. may be used.

As examples of synthetic oils mention may be made of polyolefins, alkylbenzenes, alkylnaphthalenes, polyoxyalkylene glycols, various esters (for example, polyol esters, dibasic acid esters, phosphate esters), polyoxyalkylene glycol esters, polyoxyalkylene glycol ethers, polyphenyl ethers, dialkyldiphenyl ethers, fluorine-containing compounds (perfluoropolyethers, fluorinated polyolefins) and silicone oils. These belong to Groups IV and V.

The aforementioned polyolefins include polymers of various olefins or hydrides thereof. Any olefin may be used, and as examples mention may be made of ethylene, propylene, butene and α-olefins with five or more carbons. In the manufacture of polyolefins, one kind of the aforementioned olefins may be used singly or two or more kinds may be used in combination. Particularly suitable are the polyolefins called poly-α-olefins (PAO). These are base oils of Group IV. The viscosity of these synthetic oils is not specially limited, but the kinematic viscosity at 40° C. may preferably be from 2 to 680 $mm^2/s$ and more preferably from 8 to 220 $mm^2/s$.

GTLs (gas to liquid oils) synthesised by the Fischer-Tropsch method of converting natural gas to liquid fuel have a very low sulphur content and aromatic content compared with mineral oil base oils refined from crude oil and have a very high paraffin constituent ratio, and so have excellent oxidative stability, and because they also have extremely small evaporation losses, they are suitable as base oils for this invention. These are Group III base oils. The viscosity characteristics of GTL base oils are not specially limited, but normally the viscosity index may be from 130 to 180 and preferably from 140 to 175. Also, the kinematic viscosity at 40° C. may be from 2 to 680 $mm^2/s$ and preferably from 5 to 120 $mm^2/s$. Normally the total sulphur content is also less than 10 ppm and the total nitrogen content less than 1 ppm. A commercial example of such a GTL base oil is Shell XHVI (registered trademark).

In this invention, it is possible to use the aforementioned mineral oils for the base oil either as one kind alone or in combinations of two or more kinds. The aforementioned synthetic oils may also be used as one kind or as combinations of two or more kinds. Further, it is possible to use combinations of one or more kinds of mineral oil and one or more kinds of synthetic oil.

Apart from the base oil and anti-wear agent, it is effective to add various additives to the lubricating composition of this invention, in accordance with the applications of the lubricating oil, such as are normally used to improve specific properties, for example metallic detergents, defoaming agents, ashless dispersants, anti-oxidants, friction modifiers, metal deactivators, viscosity index improvers, pour-point depressants and so on, so long as they are within a range that does not impair the objective of the invention.

It is preferable if the amount of these supplementary additives blended in is normally in the range of approximately from 0.05 to 25% by weight in terms of the total amount of the composition.

Detergents are normally incorporated in the proportion of from 0.1 to 10% by weight and preferably from 0.5 to 5% by weight, and as to kinds thereof mention may be made of oil-soluble basic salts of alkali metals and/or alkaline earth metals, sulphonates, phenates, salicylates and so on.

Ashless dispersants are normally incorporated in the proportion of from 0.1 to 20% by weight and preferably from 0.5 to 10% by weight, and as to kinds thereof mention may be made of the polyalkenyl succinimides and polyalkenyl succinic acid esters shown in Japanese Patents 1367796, 1667140, 1302811 and 1743435. It is also possible to incorporate boronated derivatives of these compounds in the lubricating composition of this invention.

Such phenol-based anti-oxidants include 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,6-di-t-butylphenol, 2,6-di-t-butyl-4-methylphenol, 2,6-di-t-butyl-4-ethylphenol, 2,6-di-t-butyl-4-ethoxyphenol, 3,5-di-t-butyl-4-hydroxybenzylmercapto-octylacetate, n-dodecyl-3-(3,5-di-t-butyl-4-hydroxyphenyl)propionate, 2'-ethylhexyl-3-(3,5-di-t-butyl-4-hydroxyphenyl)propionate, 2,6-di-t-butyl-α-dimethylamino-p-cresol, 4,4'-methylenebis(2,6-di-t-butylphenol), 4,4'-bis(2,6-di-t-butylphenol), 2,2-bis(3,5-di-t-butyl-4-hydroxyphenyl)propane, 4,4'-cyclohexylidenebis(2,6-t-butylphenol), hexamethylene glycol bis[3-(3,5-di-t-butyl-4-hydroxyphenyl)propionate](Irganox L109, made by Ciba Specialty Chemicals Ltd.), 2,2'-thio-[diethyl-3-(3,5-di-t-butyl-4-hydroxyphenyl)propionate (Irganox L115, made by Ciba Specialty Chemicals Ltd.), tetrakis[methylene-3-(3,5-di-t-butyl-4-hydroxyphenyl)propionate]methane (Irganox L101, made by Ciba Specialty Chemicals Ltd.), 1,3,5-trimethyl-2,4,6-tris(3,5-di-t-butyl-4-hydroxybenzyl)benzene (Ionox 330, made by Shell Japan Ltd.), bis-[3,3'-bis-(4'-hydroxy-3'-t-butylphenyl)butyric acid]glycol ester, 2-(3',5'-di-t-butyl-4-hydroxyphenyl)methyl-4-(2",4"-di-t-butyl-3"-hydroxyphenyl)methyl-6-t-butylphenol and 2,6,-bis(2"-hydroxy-3'-t-butyl-5'-methyl-benzyl)-4-methylphenol. As examples of the aforementioned amine-based anti-oxidants, mention may be made of p,p'-dioctyl-diphenylamine, p,p'-di-α-methylbenzyl-diphenylamine, N-p-butylphenyl-N-p'-octylphenylamine, mono-t-butyldiphenylamine, monooctyldiphenylamine, di(2,4-diethylphenyl)amine, di(2-ethyl-4-nonylphenyl)amine, octyl-phenyl-1-naphthylamine, N-t-dodecylphenyl-1-naphthylamine, 1-naphthylamine, phenyl-1-naphthylamine, phenyl-2-naphthylamine, N-hexylphenyl-2-naphthylamine, N-octylphenyl-2-naphthylamine, N,N'-diisopropyl-p-phenylenediamine and N,N'-diphenyl-p-phenylenediamine. Further, mention may be made of organomolybdenum compounds such as molybdenum dithiocarbamates and molybdenum alkylamines. These may be used singly or in combinations of several kinds, and may be used in the proportions of from 0.01 to 10% by weight and preferably from 0.1 to 5% by weight.

Viscosity index improvers may be incorporated in the lubricating composition of this invention as required, As examples of such viscosity index improvers, mention may be made of the styrene-butadiene copolymers, styrene-isoprene star copolymers, polymethacrylates and ethylene-propylene copolymers disclosed in Japanese Patents 954077, 1031507, 1468752, 1764494 and 1751082. These are used in the proportion of from 1 to 20% by weight. It is also possible likewise to use dispersant viscosity index improvers in which a polar monomer containing nitrogen or oxygen atoms in its molecules is copolymerised with these. In general use is made of polymethacrylates, olefin copolymers such as ethylene-propylene copolymers and styrene-butadiene copolymers, polybutenes, or dispersant instances which endow these with dispersion properties.

Polymethacrylates are preferred in particular. The molecular weight of the polymethacrylate used will be from 10,000 to 2,000,000, from 100,000 to 500,000 being particularly preferred. Viscosity index improvers such as polymethacrylates are normally blended in the composition in the proportion of from 0.5 to 20% by weight and preferably from 1 to 10% by weight.

For pour-point depressants its is possible to use the polymethacrylates disclosed in Japanese Patents 1195542 and 1264056. For corrosion preventatives it is possible to use alkenyl succinic acids or partial esters thereof, benzotriazole-based compounds, thiadiazole-based compounds and so on.

For defoaming agents it is possible to use polydimethylsiloxanes and polyacrylate-based compounds and so on.

The polydimethylsiloxanes used in the lubricating composition of this invention as a defoaming agent are represented by the following General Formula (4).

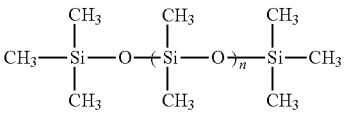

(4)

In General Formula (4), n is a positive integer and is a value corresponding to the viscosity.

The aforementioned polydimethylsiloxanes preferably have a kinematic viscosity at 25° C. of approximately from 10,000 to 60,000 $mm^2/s$. Naturally, the incorporation of polydimethylsiloxanes with viscosities lower than the aforementioned is not excluded, but if the amount contained becomes too high, the lubricating oil becomes turbid, or it settles without dispersing within the lubricating oil, and so it is necessary to limit the content to a suitable amount so that this does not happen. These polydimethylsiloxanes may be used singly or in combinations of two or more kinds with different viscosities. As to the amount thereof used, they are incorporated in the base oil in the proportion of approximately from 0.1 to 30 ppm (ppm by weight and likewise below) as converted to Si and in terms of the total amount of the composition. If the amount is less than 0.1 ppm, there may be no defoaming effect. If it exceeds 30 ppm the lubricating composition may become turbid and there may even be no defoaming effect. The range of approximately from 3 to 10 ppm is even more preferable.

On the other hand, for polyacrylate-based defoaming agents, it is best if the molecular weight is approximately from 4,000 to 150,000. As to the amount used, it is best if the amount added (ppm) is such as to be 60 times or higher relative to the Si amount (ppm) of the aforementioned polydimethylsiloxanes when used in combination. Also, so long as it is within the range of normal additive amounts, the upper limit is not specially restricted, but there may be a problem with reduction of demulsification properties and it is often preferable to make it not more than 0.5% by weight, and even more preferably not more than 0.2% by weight.

By virtue of this invention, it has been possible to offer a superior novel anti-wear agent, and it has also been possible to offer a lubricating composition having superior anti-wear properties without using the techniques of the prior art.

FIG. 1 is an outline drawing of a high-speed four-ball wear test.

EXAMPLES

The invention is further explained below by means of Examples, but the invention is in no way limited by these. Also, the methods of preparation given below are examples and are absolutely not limited to these.

Example 1

Ligand 6a: Synthesis of imino-bis(diisopropylphosphine sulphide)

Synthesis method: D. Cupertino et al., Inorg. Chem., 1996, 35, 2695-2697

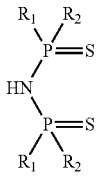

$R_1 = R_2$ = isopropyl

-continued

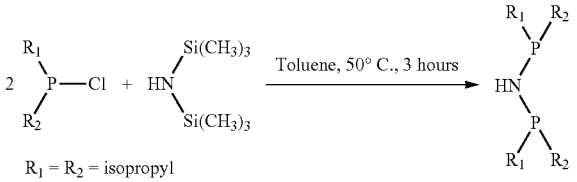

$R_1 = R_2$ = isopropyl

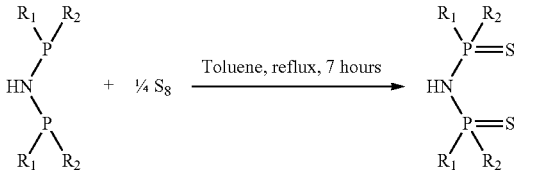

$R_1 = R_2$ = isopropyl

Test Method

Hexamethyldisilazane (2.64 g, 16.4 mmol) was added in an argon atmosphere to a 300 ml three-necked flask fitted with a reflux tube and dissolved in 50 ml of toluene. Then, while heating the flask to 50° C., 100 ml of a toluene solution of chlorodiisopropylphosphine (5.00 g, 32.8 mmol) were dribbled in over 30 minutes using a dropping funnel, agitating for a further 3 hours.

After cooling to room temperature, simple sulphur (1.05 g, 4.10 mmol) was added, and reflux was carried out with heating for a further 7 hours. It was then left for 1 day at 0° C. The white crystals obtained were refined by carrying out recrystallisation from dichloromethane and n-hexane after washing in carbon disulphide and n-hexane.

| Form | Colourless, transparent crystals |
|---|---|
| Amount of yield | 1.33 g |
| % yield | 26% |

Example 2

Complex 6b: Synthesis of zinc [imino-bis(diisopropylphosphine sulphide)]$_2$

Synthesis method: D. Cupertino et al., Inorg. Chem., 1996, 35, 2695-2697

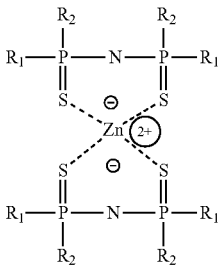

$R_1 = R_2$ = isopropyl

-continued

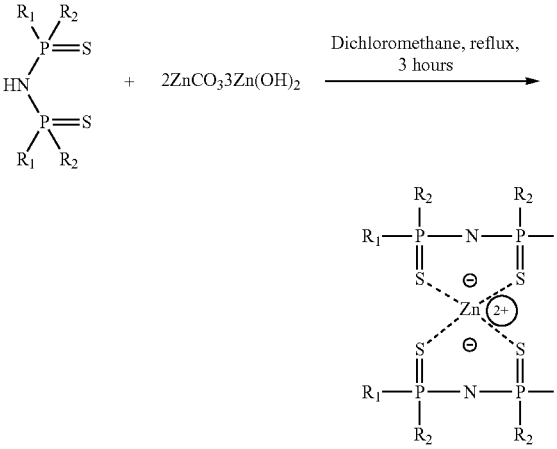

$R_1 = R_2$ = isopropyl

Test Method

Ligand 6a (1.33 g, 4.26 mmol) and zinc carbonate hydroxide (1-10 g, 3.21 mmol) were added to a 300 ml three-necked flask fitted with a reflux tube, and reflux was carried out in dichloromethane (100 ml, distillation solvent) while heating for 3 hours. Then, approximately ⅓ of the liquid obtained by filtration was distilled off under vacuum and it was left to stand for 1 day at 0° C. The colourless and transparent crystals obtained were extracted in dichloromethane and water. The organic layer obtained was distilled off under vacuum and then it was refined by carrying out recrystallisation from dichloromethane and n-hexane.

| Form | Colourless, transparent crystals |
|---|---|
| Amount of yield | 1.06 g |
| % yield | 72% |

Example 3

Ligand 7a: Synthesis of imino-bis(diphenylphosphine sulphide)

Synthesis method: D. Cupertino et al., Inorg. Chem., 1996, 35, 2695-2697

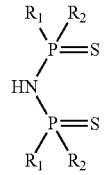

$R_1 = R_2$ = phenyl

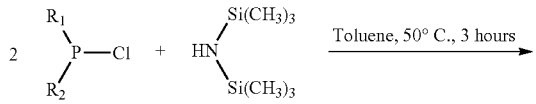

-continued

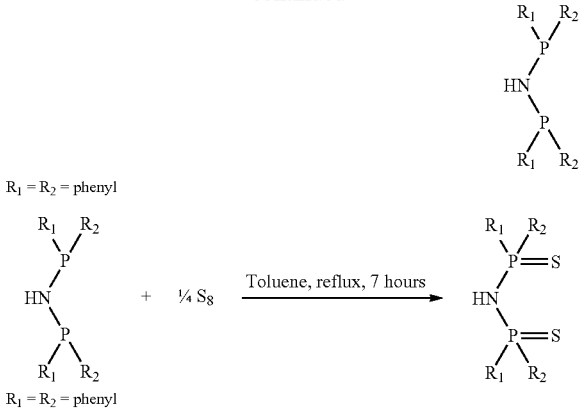

Test Method

Hexamethyldisilazane (3.66 g, 22.7 mmol) was added in an argon atmosphere to a 300 ml three-necked flask fitted with a reflux tube and dissolved in 100 ml of toluene. Then, while heating the flask to 50° C., 100 ml of a toluene solution of chlorodiphenylphosphine (10.0 g, 45.3 mmol) were dribbled in over 30 minutes using a dropping funnel, agitating for a further 3 hours.

After cooling to room temperature, simple sulphur (1.45 g, 5.67 mmol) was added, and reflux was carried out with heating for a further 7 hours. It was then left for 1 day at 0° C. The white crystals obtained were refined by carrying out recrystallisation from dichloromethane and n-hexane after washing in carbon disulphide and n-hexane.

| Form | White crystals |
|---|---|
| Amount of yield | 7.24 g |
| % yield | 71% |

Example 4

Complex 7b: Synthesis of zinc [imino-bis(diphenylphosphine sulphide)]$_2$

Synthesis method: D. Cupertino et al., Inorg. Chem., 1996, 35, 2695-2697

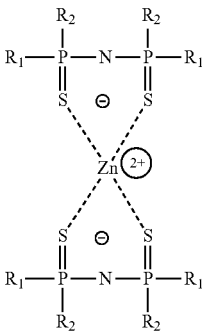

$R_1 = R_2$ = phenyl

-continued

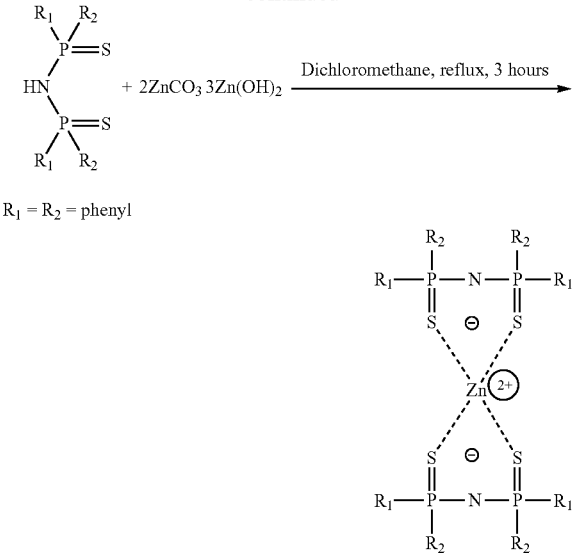

Test Method

Synthesised amino-bis(diphenylphosphine chalcogenide) (2.81 g, 6.68 mmol) was added in the ordinary atmosphere to a 500 ml three-necked flask fitted with a reflux tube, with 300 ml of dichloromethane as a solvent. After dissolving the ligand in the solvent, zinc carbonate hydroxide (1.10 g, 3.21 mmol) was added and reflux was carried out under heat while maintaining the temperature of the oil bath at 70° C. Then, removing the raw material left after filtration, the filtrate liquid was reduced to approximately ⅔ by evaporation, and it was left to stand for 1 day while keeping the temperature at 0° C., white crystals being obtained. The crystals obtained were dissolved in dichloromethane and extraction was carried out after further adding purified water and transferring to a separating funnel. Recrystallisation was then carried out by using dichloromethane and n-hexane in the ratio 1:1.

| Form | White crystals |
|---|---|
| % yield | 58% |

Comparative Examples 1 to 2 and Examples 5 to 10

Comparative Example 1 and 2, containing API Group III mineral oil (viscosity at 100° C.: 4.2 mm$^2$/s) or synthetic ester base oil (trimethylolpropane carboxylic acid ester; kinematic viscosity at 100° C.: 4.5 mm$^2$/s) to which had been added 5% dispersant (alkenyl succinate polyalkylene polyamide, trade name Infinum 09266) and Examples 5 to 10 containing the compounds synthesised in Examples 1 to 4 and API Group III mineral oil (viscosity at 100° C.: 4.2 mm$^2$/s) or synthetic ester base oil (trimethylolpropane carboxylic acid ester; kinematic viscosity at 100° C.: 4.5 mm$^2$/s) to which had been added 5% dispersant (alkenyl succinate polyalkenyl polyamide, trade name Infinum C9266), were each prepared to give the weight % concentrations shown in Table 1.

An evaluation of the anti-wear properties of these sample oils was carried out using a high-speed four-ball anti-wear testing rig in accordance with the test method JPI-5S-32-90 specified by the Japan Petroleum Institute. As shown in FIG. 1, three steel balls were set firmly in the bottom of a sample container and the oil to be tested was added. Under temperature conditions of 75° C., a load (40 kgf) was applied from above to the rotating ball and rotation was continued for 60 minutes at a speed of 1200 revolutions per minute. After the test, measurements were made of the wear mark diameters of the three steel balls fixed at the bottom caused at the contact points with the upper rotating ball, so as to evaluate the anti-wear properties. The results are shown in Table 1.

As is shown for Examples 5 to 10 in Table 1, the phosphorus compounds given for Examples 1 to 4 were all confirmed to have anti-wear properties superior to those of Comparative Examples 1 and 2.

TABLE 1

| | | Comp. Ex. 1 | Comp. Ex. 2 | Ex. 5 | Ex. 6 | Ex. 7 | Ex. 8 | Ex. 9 | Ex. 10 |
|---|---|---|---|---|---|---|---|---|---|
| Mineral oil [1] | weight % | Rest | — | Rest | Rest | — | — | — | — |
| Ester [2] | weight % | — | Rest | — | — | Rest | Rest | Rest | Rest |
| Ligand (6a) | weight % | — | — | 0.5 | — | 1.0 | — | — | — |
| Ligand (7a) | weight % | — | — | — | — | — | 0.5 | — | — |
| Complex (6b) | weight % | — | — | — | 0.5 | — | — | 1.0 | — |
| Complex (7b) | weight % | — | — | — | — | — | — | — | 0.5 |
| Dispersant [3] | weight % | 5.0 | 5.0 | 5.0 | 5.0 | 5.0 | 5.0 | 5.0 | 5.0 |
| P concentration | weight % | — | — | 0.09 | 0.09 | 0.19 | 0.07 | 0.18 | 0.06 |
| Wear mark [4] | mm | 0.80 | 0.88 | 0.50 | 0.57 | 0.70 | 0.63 | 0.68 | 0.49 |

[1] API Group III mineral oil (viscosity at 100° C.: 4.2 $mm^2/s$) [YUBASE 4 manufactured by SK Energy Co. Ltd.]
[2] Trimethylolpropane carboxylic acid ester (viscosity at 100° C.: 4.5 $mm^2/s$)
[3] Alkenyl succinic acid polyalkylene polyamide, trade name Infinum C9266
[4] Based on test method of JPI-5S-32-90 (Anti-wear properties, that is lubricity, are higher the smaller the "wear mark"). 1200 rpm, 40 kgf, 75° C., 60 minutes

We claim:

1. A lubricating composition comprising:

a base oil, and an anti-wear compound present in an amount from 0.01 to 10% by weight in terms of elemental phosphorus and based on the total amount of the lubricating composition, and wherein the anti-wear compound is represented by the following General Formula (2) or General Formula (3):

(2)

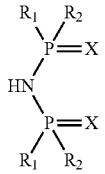

(3)

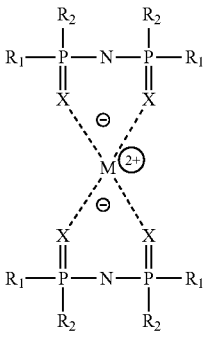

wherein in General Formulas (2) and (3), $R_1$ and $R_2$ each independently represent a group selected from the group consisting of: hydrogen, an alkyl group with from 1 to 30 carbon atoms, a cycloalkyl group and an aryl group; and wherein X denotes an oxygen atom or sulfur atom, and M denotes a metal atom selected from the group consisting of zinc, molybdenum, copper and tungsten.

2. The lubricating composition according to claim 1 wherein the anti-wear compound is present in an amount from 0.03 to 5% by weight in terms of elemental phosphorus and based on the total amount of the lubricating composition.

3. The lubricating composition according to claim 1 wherein X denotes a sulfur atom.

4. The lubricating composition according to claim 1 wherein the metal atom is zinc.

5. The lubricating composition according to claim 1 wherein the anti-wear compound is represented by the following General Formula (2):

(2)

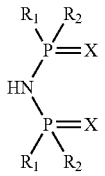

wherein $R_1$ and $R_2$ each independently represent a group selected from the group consisting of: hydrogen, an alkyl group with from 1 to 30 carbon atoms, a cycloalkyl group and an aryl group; and wherein X denotes an oxygen atom or sulfur atom.

6. The lubricating composition according to claim 5 wherein X denotes a sulfur atom.

7. The lubricating composition according to claim 1 wherein the anti-wear compound is represented by the following General Formula (3):

(3)

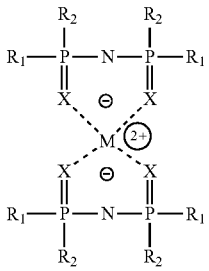

wherein in General Formula (3), $R_1$ and $R_2$ each independently represent a group selected from the group consisting of: hydrogen, an alkyl group with from 1 to 30 carbon atoms, a cycloalkyl group and an aryl group; and wherein X denotes an oxygen atom or sulfur atom, and M denotes a metal atom selected from the group consisting of zinc, molybdenum, copper and tungsten.

8. The lubricating composition according to claim 7 wherein the metal atom is zinc.

9. The lubricating composition according to claim 7 wherein X denotes a sulfur atom.

10. A method comprising:

applying a lubricating composition to a surface in relative movement to another surface, wherein the lubricating composition comprises a base oil, and an anti-wear compound present in an amount from 0.01 to 10% by weight in terms of elemental phosphorus and based on the total amount of the lubricating composition, and wherein the anti-wear compound is represented by the following General Formula (2) or General Formula (3):

(2)

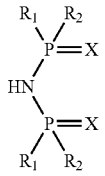

(3)

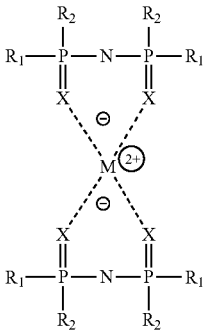

wherein in General Formulas (2) and (3), $R_1$ and $R_2$ each independently represent a group selected from the group consisting of: hydrogen, an alkyl group with from 1 to 30 carbon atoms, a cycloalkyl group and an aryl group; and wherein X denotes an oxygen atom or sulfur atom, and M denotes a metal atom selected from the group consisting of zinc, molybdenum, copper and tungsten.

11. The method according to claim 10 wherein the anti-wear compound is present in an amount from 0.03 to 5% by weight in terms of elemental phosphorus and based on the total amount of the lubricating composition.

12. The method according to claim 10 wherein X denotes a sulfur atom.

13. The method according to claim 10 wherein the metal atom is zinc.

14. The method according to claim 10 wherein the anti-wear compound is represented by the following General Formula (2):

(2)

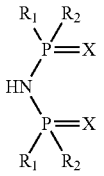

wherein $R_1$ and $R_2$ each independently represent a group selected from the group consisting of: hydrogen, an alkyl group with from 1 to 30 carbon atoms, a cycloalkyl group and an aryl group; and wherein X denotes an oxygen atom or sulfur atom.

15. The method according to claim 14 wherein X denotes a sulfur atom.

16. The method according to claim 10 wherein the anti-wear compound is represented by the following General Formula (3):

(3)

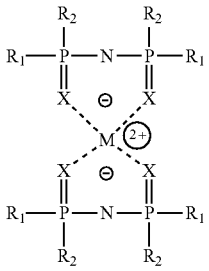

wherein in General Formula (3), $R_1$ and $R_2$ each independently represent a group selected from the group consisting of: hydrogen, an alkyl group with from 1 to 30 carbon atoms, a cycloalkyl group and an aryl group; and wherein X denotes an oxygen atom or sulfur atom, and M denotes a metal atom selected from the group consisting of zinc, molybdenum, copper and tungsten.

17. The method according to claim 16 wherein the metal atom is zinc.

18. The method according to claim 16 wherein X denotes a sulfur atom.

* * * * *